US011965296B2

(12) United States Patent
Mateychuk

(10) Patent No.: US 11,965,296 B2
(45) Date of Patent: Apr. 23, 2024

(54) COUNTERBALANCED INGROUND TRAFFIC CONTROL DEVICE

(71) Applicant: Roadshark International Inc., Winnipeg (CA)

(72) Inventor: Jonathon R. Mateychuk, Winnipeg (CA)

( * ) Notice: Subject to any disclaimer, the term of this patent is extended or adjusted under 35 U.S.C. 154(b) by 168 days.

(21) Appl. No.: 17/836,192

(22) Filed: Jun. 9, 2022

(65) Prior Publication Data

US 2022/0298734 A1 Sep. 22, 2022

Related U.S. Application Data

(62) Division of application No. 16/890,363, filed on Jun. 2, 2020, now Pat. No. 11,767,650, which is a division of application No. 16/215,941, filed on Dec. 11, 2018.

(51) Int. Cl.
*E01F 13/12* (2006.01)
*E01F 13/10* (2006.01)

(52) U.S. Cl.
CPC ..... *E01F 13/123* (2013.01); *E01F 13/105* (2013.01)

(58) Field of Classification Search
None
See application file for complete search history.

(56) References Cited

U.S. PATENT DOCUMENTS 1,527,107 A * 2/1925 Allen ..... E01F 9/529 404/6
2,762,145 A * 9/1956 Rupe ..... E01F 13/105 404/6
4,016,679 A * 4/1977 Ellefson ..... E01F 13/10 49/35
4,097,170 A * 6/1978 Dickinson ..... E01F 13/105 404/11
4,158,514 A * 6/1979 Dickinson ..... E01F 13/123 404/6
6,045,293 A * 4/2000 Dickinson ..... E01F 13/123 404/6
7,025,526 B2 * 4/2006 Blair ..... E01F 13/105 404/9

(Continued)

FOREIGN PATENT DOCUMENTS

ES 2279670 A1 * 8/2007 ..... E01F 11/00
FR 2522036 A1 * 8/1983

(Continued)

*Primary Examiner* — Thomas B Will
*Assistant Examiner* — Katherine J Chu
(74) *Attorney, Agent, or Firm* — Ryan W. Dupuis; Kyle R. Satterthwaite; Ade & Company Inc.

(57) ABSTRACT

A traffic control device, for use with a roadway receiving vehicles travelling longitudinally along the roadway, includes a housing mounted transversely across the roadway with an upper supporting surface that supports the vehicles rolling over the housing. A tire puncturing frame comprised of a shaft supporting tire puncturing members thereon is rotatable within the housing between stored and working positions of the tire puncturing members relative to the upper supporting surface of the housing. Offset counterweights are coupled to the frame to bias the tire puncture members towards the working position. A latch bolt threaded into a threaded aperture in the housing selectively retains the tire puncturing frame in the stored position.

11 Claims, 8 Drawing Sheets

(56) References Cited

U.S. PATENT DOCUMENTS

| | | | | |
|---|---|---|---|---|
| 11,603,634 | B2 * | 3/2023 | Mateychuk | E01F 13/123 |
| 11,767,650 | B2 * | 9/2023 | Mateychuk | E01F 13/123<br>404/11 |
| 2005/0265781 | A1 * | 12/2005 | Blair | E01F 13/12<br>404/6 |

FOREIGN PATENT DOCUMENTS

| | | | | |
|---|---|---|---|---|
| FR | 2607162 | A1 * | 5/1988 | |
| FR | 2622614 | A3 * | 5/1989 | |
| FR | 2986017 | A3 * | 7/2013 | E01F 13/105 |
| GB | 2253430 | A * | 9/1992 | E01F 13/123 |
| GB | 2451065 | A * | 1/2009 | E01F 13/10 |
| KR | 101758787 | B1 * | 7/2017 | |
| WO | WO-9530052 | A1 * | 11/1995 | E01F 13/123 |
| WO | WO-2009123485 | A1 * | 10/2009 | E01F 13/105 |

* cited by examiner

COUNTERBALANCED INGROUND TRAFFIC CONTROL DEVICE

This application is a divisional of US parent application Ser. No. 16/890,363, filed Jun. 2, 2020, which is a divisional of US parent application Ser. No. 16/215,941, filed Dec. 11, 2018.

FIELD OF THE INVENTION

The present invention relates to a traffic control device having a housing arranged to be supported across a roadway and which includes a plurality of tire puncturing members which are supported within the housing for pivotal movement between stored position retracted into the housing and a working position protruding upwardly from the housing.

BACKGROUND

There are a variety of applications in the field of directing vehicular traffic where it is desirable to allow passage of vehicles in a first direction at a controlled location while preventing flow of traffic in the opposing direction. Examples include entrance and exit locations of parking structures, parking lots, or even entire neighbourhoods. A common device for limiting the flow of traffic in one direction involves the housing mounted across the direction of traffic on a roadway in which a plurality of tire puncturing members are pivotally supported within the housing such that each member protrudes upwardly from the housing in a working orientation which is adapted to puncture tires in response to vehicles travelling over the housing in a first direction while being adapted to readily pivot into a retracted position within the housing without damaging tires in response to vehicles travelling over the housing into an opposing second direction.

U.S. Pat. No. 5,588,774 by Behan and U.S. Pat. No. 7,025,526 by Blair disclose examples of typical traffic control devices. The tire puncturing members are biased into the working position using springs; however, the springs required considerable cost and labour to maintain and replace due to the frequent failure of the springs resulting from the large number of cycles that the traffic device undergoes in high traffic areas. Known traffic control devices may also be undesirable in certain applications due to the considerable noise generated by the metallic parts being cycled between working and retracted positions of the tire puncturing members with each passing vehicle. Known constructions of traffic control devices also provide limited ability to calibrate the positioning of the various operating components relative to the housing in a manner that ensures the optimal performance of the tire puncturing members to be effective at puncturing tires of vehicles passing in the wrong direction without being cumbersome to vehicles passing in the permissible direction.

SUMMARY OF THE INVENTION

According to one aspect of the invention there is provided a traffic control device for use with a roadway receiving vehicles travelling longitudinally along the roadway in a travel direction, the device comprising:

a housing which is elongate in a longitudinal direction and which is adapted to be mounted to extend across the roadway transversely to the travel direction;

the housing having an upper supporting surface adapted to support the vehicles rolling over the housing;

the upper supporting surface having a plurality of upper openings formed therein;

a plurality of tire puncturing members having respective pointed ends adapted to puncture tires of the vehicles;

the tire puncturing members being pivotal relative to the housing about a common pivot axis between a stored position in which the tire puncturing members are retracted below the upper supporting surface of the housing and a working position in which the pointed ends of the tire puncturing members protrude upwardly beyond the upper supporting surface of the housing through the upper openings formed therein;

at least one counterweight member operatively connected to the tire puncturing members such that the counterweight member is pivotal together with the tire puncturing members between the working position and the stored position;

said at least one counterweight member being angularly offset about the pivot axis relative to the pointed ends of the tire puncturing members and having a mass biasing the tire puncturing members towards the working position under force of gravity alone.

Use of counterweight members for biasing the tire puncturing members into the working position provides a reliable means of rapidly deploying the tire puncturing members which overcomes the high maintenance costs associated with springs which fail under repeated cyclings of the tire puncturing members between working and stored positions thereof.

The one or more counterweight members are preferably supported diametrically opposed from the pointed ends of the tire puncturing members.

The tire puncturing members may be fixed onto a common pivot shaft so as to define a common tire puncturing frame in which the pivot shaft and the tire puncturing members are pivotal together relative to the housing between the working position and the stored position.

Preferably a number of the tire of puncturing members is greater than a number of said at least one counterweight members.

Each counterweight member may include an upper surface which is generally convex so as to extend laterally and opposite to the pointed ends along a downward curve.

Each counterweight member may be mounted on one or more tire puncturing members at a location diametrically opposite from the pointed ends.

The housing may further comprise a threaded aperture receiving a latch bolt threadably therein such that the latch bolt engages the tire puncturing frame in the stored position to retain the tire puncturing frame in the stored position. When the tire puncturing frame further includes a crossbar mounted on the tire puncturing frame in connection between an adjacent pair of the tire puncturing members at a location spaced radially from the pivot axis, the latch bolt preferably engages the crossbar in the stored position.

When the housing comprises a pair of side walls extending in the longitudinal direction along laterally opposing sides of the housing, preferably the pointed ends of the tire puncturing members being located directly adjacent one of the side walls in the stored position thereof.

The traffic control device may further include at least one spring member operatively connected between the tire puncturing frame and the housing to bias the tire puncturing frame towards the working position in addition to the counterweight members. Preferably two springs are supported at longitudinally opposed ends of the tire puncturing frame.

The traffic control device may further include a latching aperture formed in the housing and a latching aperture formed in the tire puncturing frame which are aligned with one another in which the latching apertures receive a common latch pin longitudinally slidable therein in the stored position to retain the tire puncturing frame in the stored position, the latch pin being slidably removable from the latching apertures.

When (i) the tire puncturing members are fixed onto a common pivot shaft such that the pivot shaft and the tire puncturing members are pivotal together relative to the housing between the working position and the stored position and (ii) the pivot shaft is axially slidable relative to the housing through a range of axial positions, preferably a lock member is supported on the pivot shaft so as to fix the pivot shaft relative to the housing at a selected one of the axial positions while enabling pivotal movement of the pivot shaft relative to the housing.

When the housing includes a pair of mounting flanges protruding laterally outwardly from opposing side walls of the housing so as to be adapted to overlap the roadway and the mounting flanges includes fastener apertures for receiving roadway anchors therethrough, preferably at least one guard member is fixed onto a top side of the mounting flanges to protrude upwardly therefrom adjacent each fastener aperture so as to be arranged to at least partially shield a roadway anchor received within the respective fastener aperture.

Furthermore, when the housing includes (i) a pair of mounting flanges protruding laterally outwardly from opposing side walls of the housing so as to be adapted to overlap the roadway and (ii) a top plate extending across a top of the housing so as to define the upper supporting surface of the housing in which the top plate is supported in overlapping relationship overtop of a top side of a corresponding one of the mounting flanges at each side edge of the top plate, preferably at least one guard member is supported on each mounting flange to protrude upwardly therefrom in proximity to the corresponding side edge of the top plate in which the guard member has a ramped upper surface which is slope upwardly towards the top plate.

According to a second aspect of the present invention there is provided a traffic control device for use with a roadway receiving vehicles travelling longitudinally along the roadway in a travel direction, the device comprising:

a housing which is elongate in a longitudinal direction and which is adapted to be mounted to extend across the roadway transversely to the travel direction;

the housing having an upper supporting surface adapted to support the vehicles rolling over the housing;

the upper supporting surface having a plurality of upper openings formed therein;

a plurality of tire puncturing members having respective pointed ends adapted to puncture tires of the vehicles;

the tire puncturing members being pivotal relative to the housing about a common pivot axis between a stored position in which the tire puncturing members are retracted below the upper supporting surface of the housing and a working position in which the pointed ends of the tire puncturing members protrude upwardly beyond the upper supporting surface of the housing through the upper openings formed therein;

the tire puncturing members being joined in fixed relation to one another to define a tire puncturing frame which is collectively pivoted between the working position and the stored position; and an upper stop member supported on the housing so as to engaged by tire puncturing frame in the working position whereby the upper stop member defines an upper limit of pivotal movement of the tire puncturing members relative to the housing;

the upper stop member being formed of resilient material.

The resilient material may be rubber or other comparable materials that are softer than steel. The use of resilient material forming the stop member both reduces noise resulting from the cycling of the tire puncturing members between the working and stored positions thereof, while also reducing some of the jarring impacts of the tire puncturing members being pivoted into the stored or working position in response to passing vehicles so as to increase the longevity of the operating components.

The tire puncturing frame may further include a crossbar mounted on the tire puncturing frame in connection between an adjacent pair of the tire puncturing members at a location spaced radially from the pivot axis, the upper stop member being engaged by the crossbar.

When the housing includes a top plate defining the upper supporting surface of the housing, the upper stop member is preferably fastened to a bottom side of the top plate.

According to a further aspect of the present invention there is provided a traffic control device for use with a roadway receiving vehicles travelling longitudinally along the roadway in a travel direction, the device comprising:

a housing which is elongate in a longitudinal direction and which is adapted to be mounted to extend across the roadway transversely to the travel direction;

the housing having an upper supporting surface adapted to support the vehicles rolling over the housing;

the upper supporting surface having a plurality of upper openings formed therein;

a plurality of tire puncturing members having respective pointed ends adapted to puncture tires of the vehicles;

the tire puncturing members being pivotal relative to the housing about a common pivot axis between a stored position in which the tire puncturing members are retracted below the upper supporting surface of the housing and a working position in which the pointed ends of the tire puncturing members protrude upwardly beyond the upper supporting surface of the housing through the upper openings formed therein;

the tire puncturing members being joined in fixed relation to one another to define a tire puncturing frame which is collectively pivoted between the working position and the stored position; and an upper stop member supported on the housing so as to engaged by tire puncturing frame in the working position whereby the upper stop member defines an upper limit of pivotal movement of the tire puncturing members relative to the housing;

the upper stop member being mounted on the housing so as to be adjustable in height relative to the upper supporting surface.

Providing stop members which are adjustable in elevation enables the traffic control device to be better calibrated at each installation location to ensure an optimal balance between puncturing of tires of vehicles passing over the housing in the wrong direction while not damaging tires or an undercarriage of vehicles passing over the housing in a permissible direction.

The tire puncturing frame may further include a crossbar mounted on the tire puncturing frame in connection between an adjacent pair of the tire puncturing members at a location spaced radially from the pivot axis, the upper stop member being engaged by the crossbar.

When the housing includes a top plate defining the upper supporting surface of the housing, the upper stop member is preferably fastened to a bottom side of the top plate.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
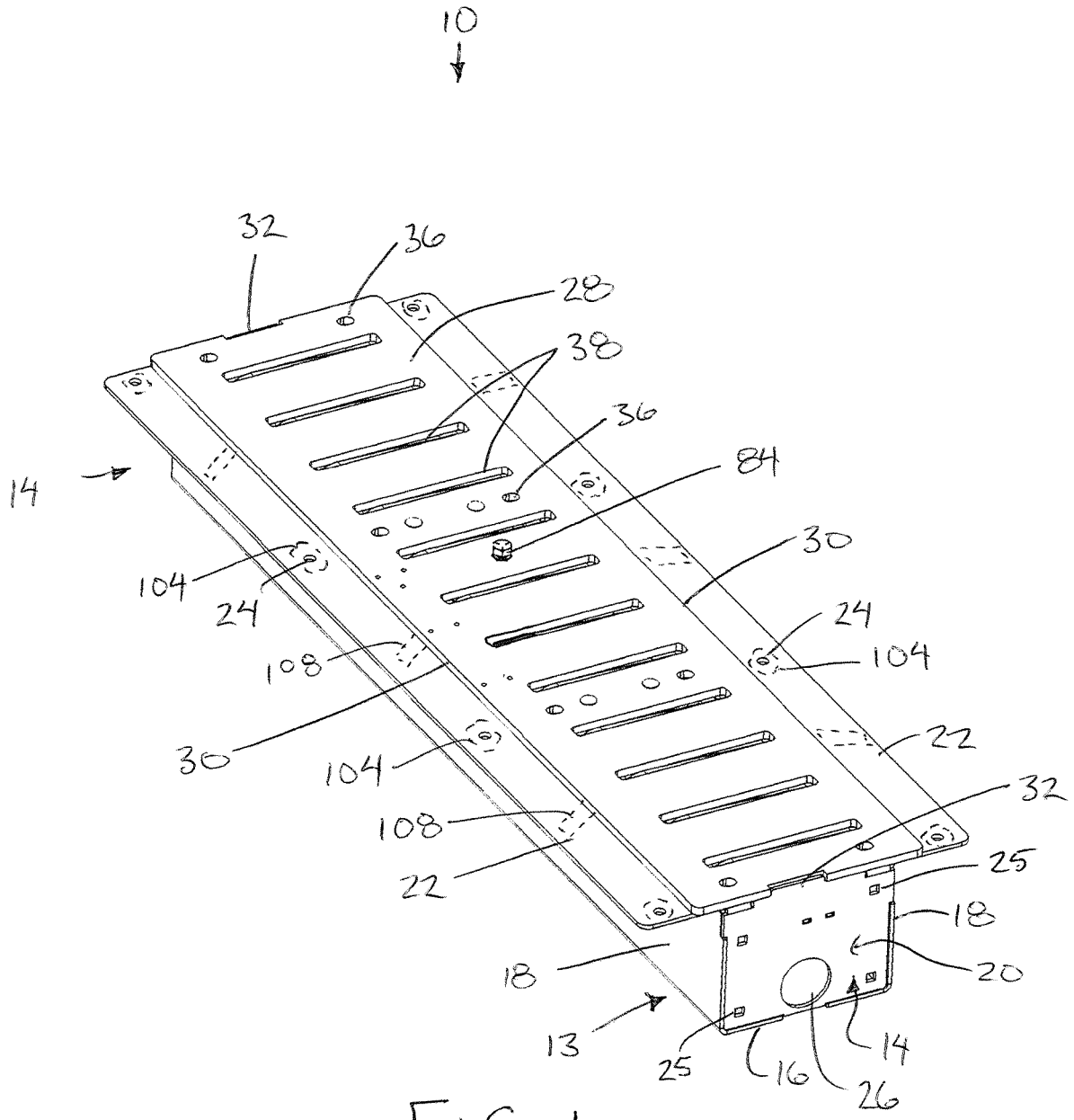
FIG. 1 is perspective view of the traffic control device.
Figure 2:
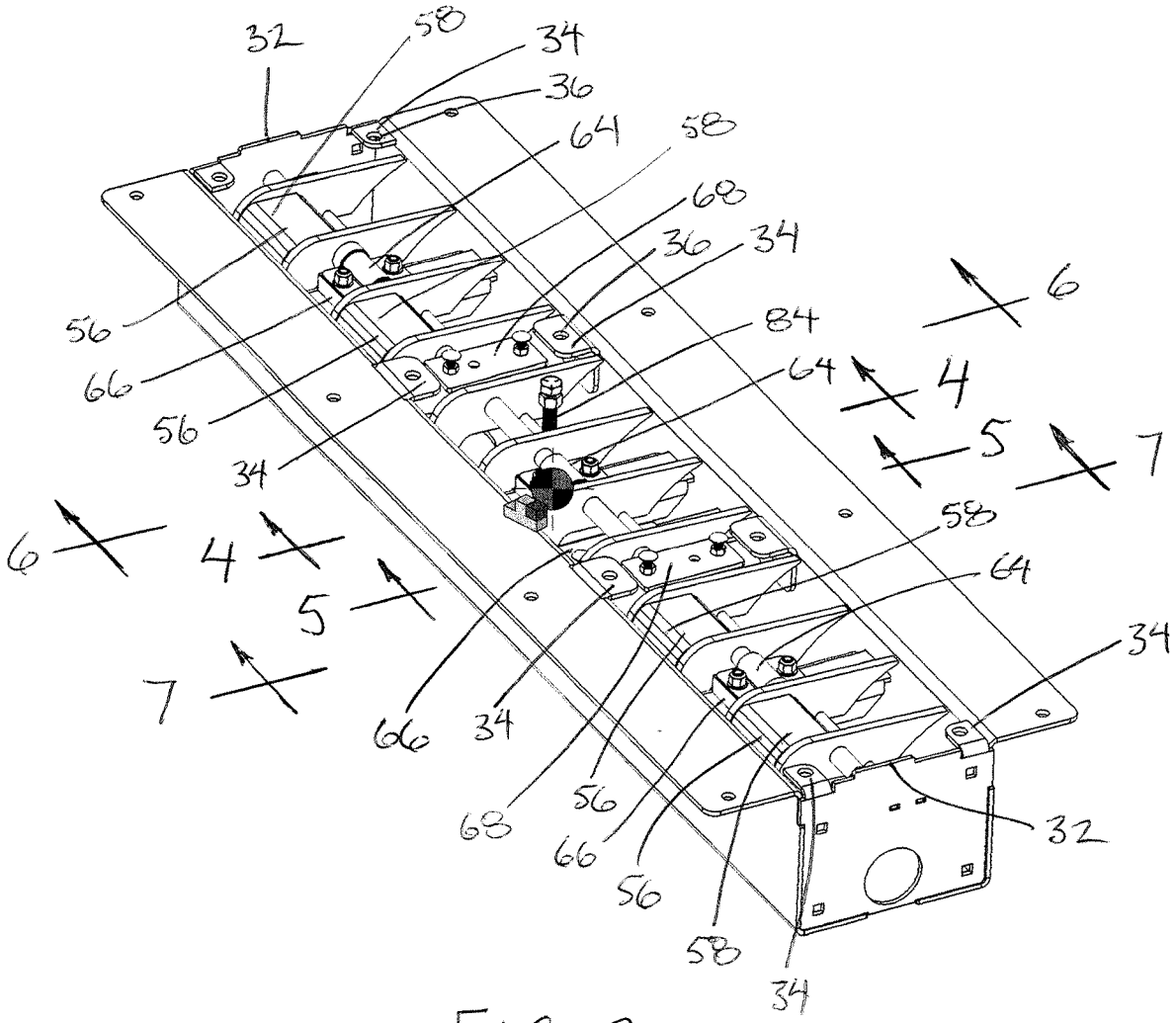
FIG. 2 is a perspective view of the traffic control device with the top plate removed.
Figure 3:
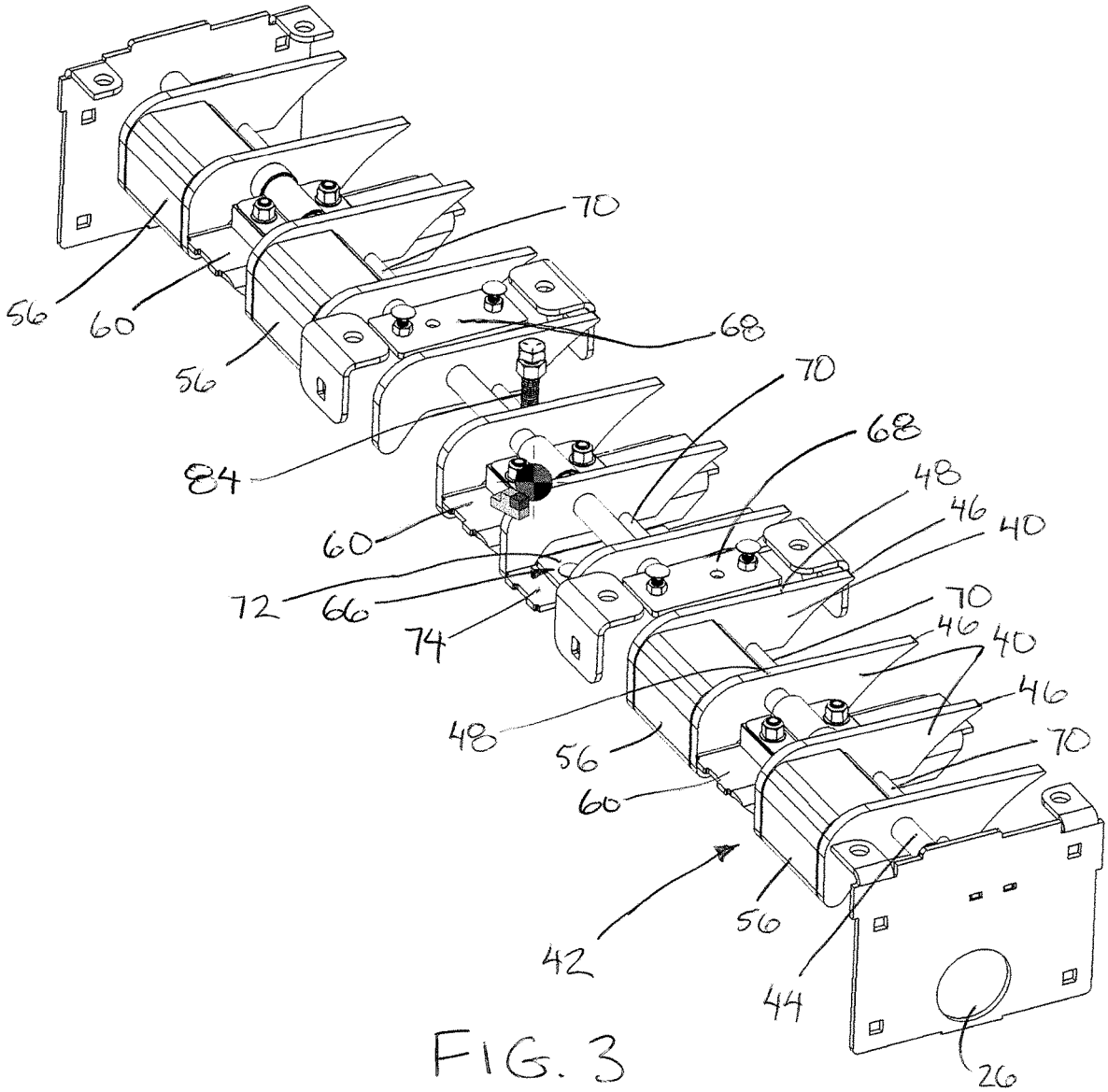
FIG. 3 is a perspective view of the traffic control device with the top plate and the lower housing removed for illustrative purposes.
Figure 4:
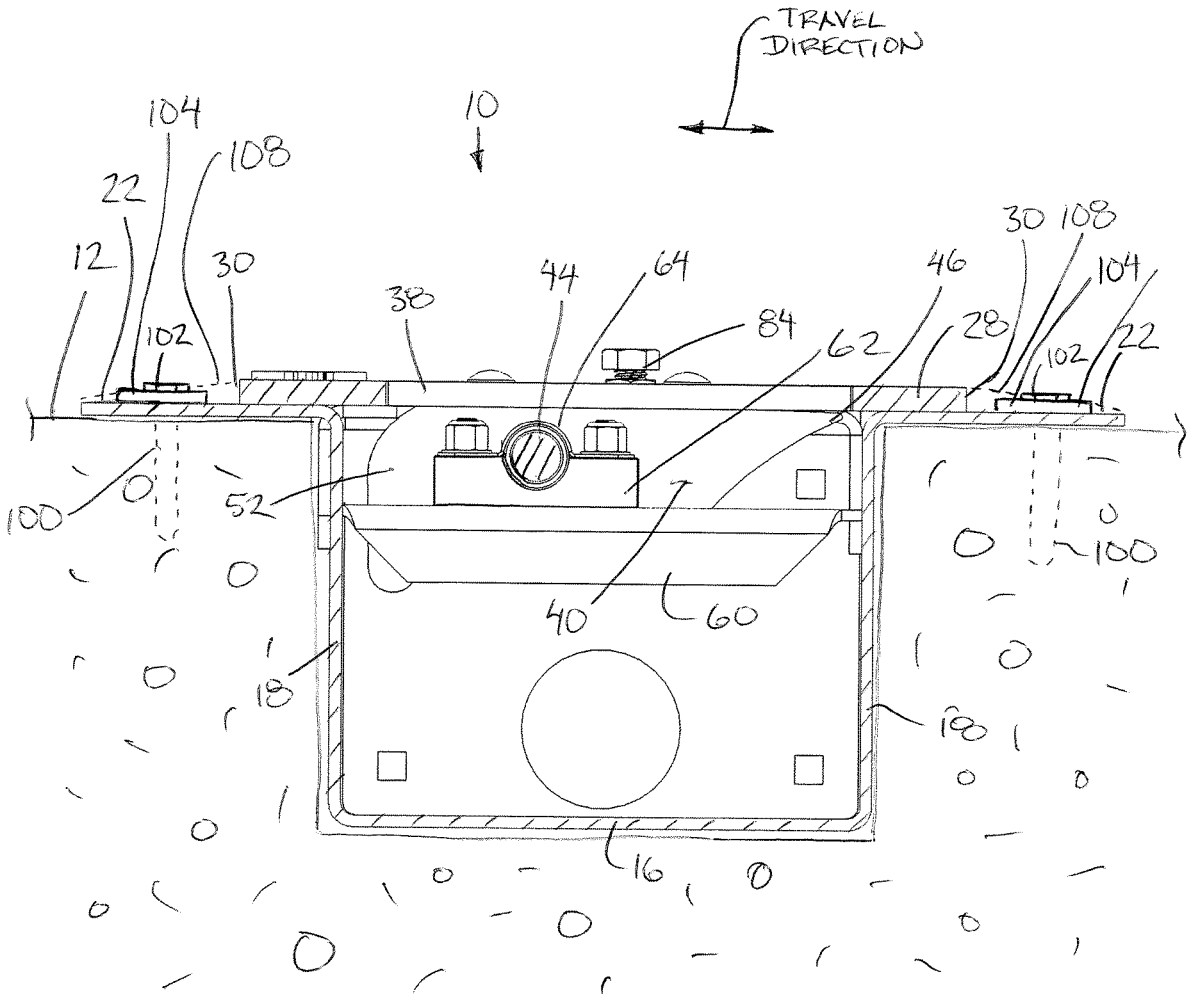
FIG. 4 is a sectional view along the line 4-4 in FIG. 2.
Figure 5:
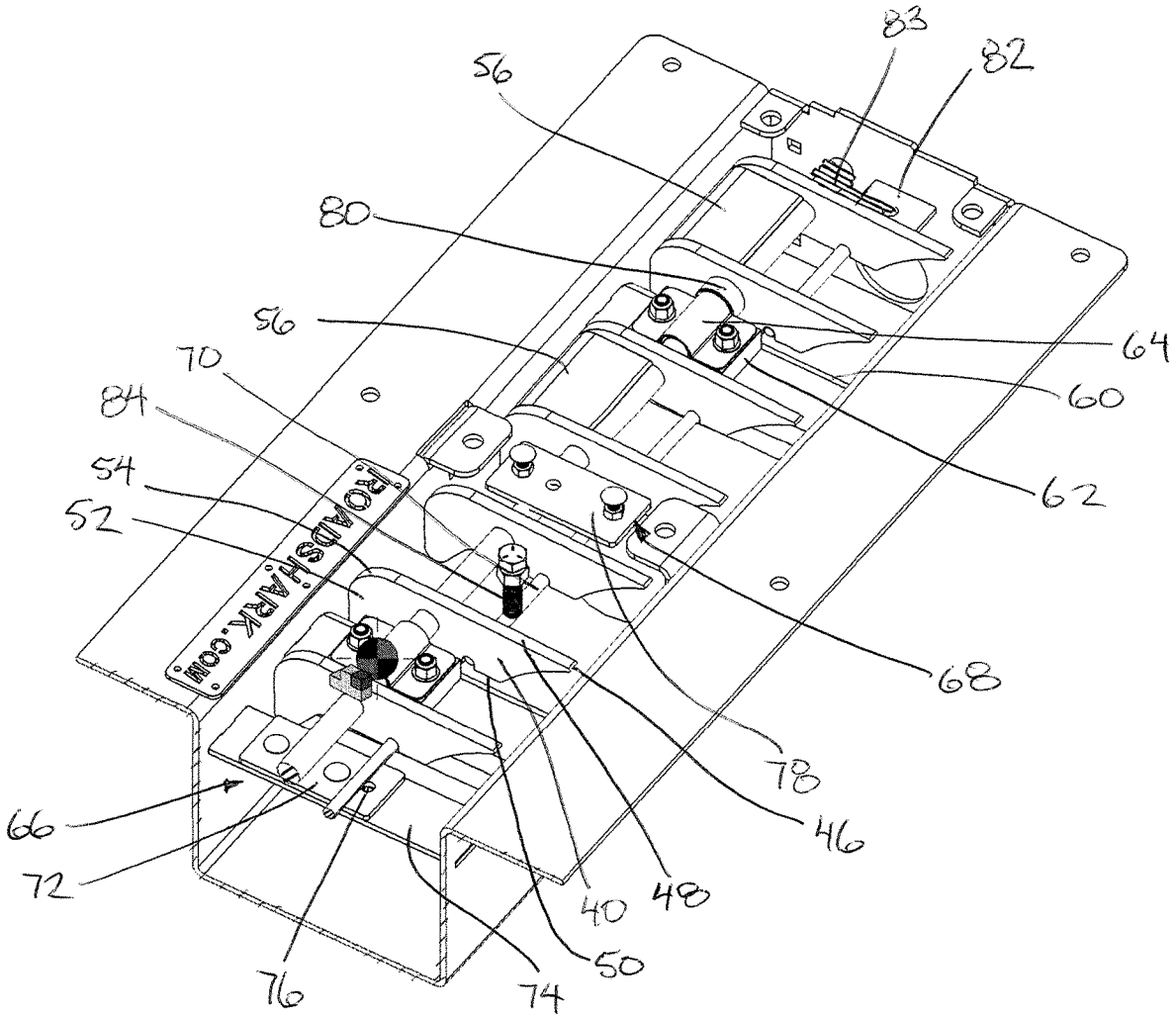
FIG. 5 is a partly sectional view along the line 5-5 in FIG. 2.
Figure 6:
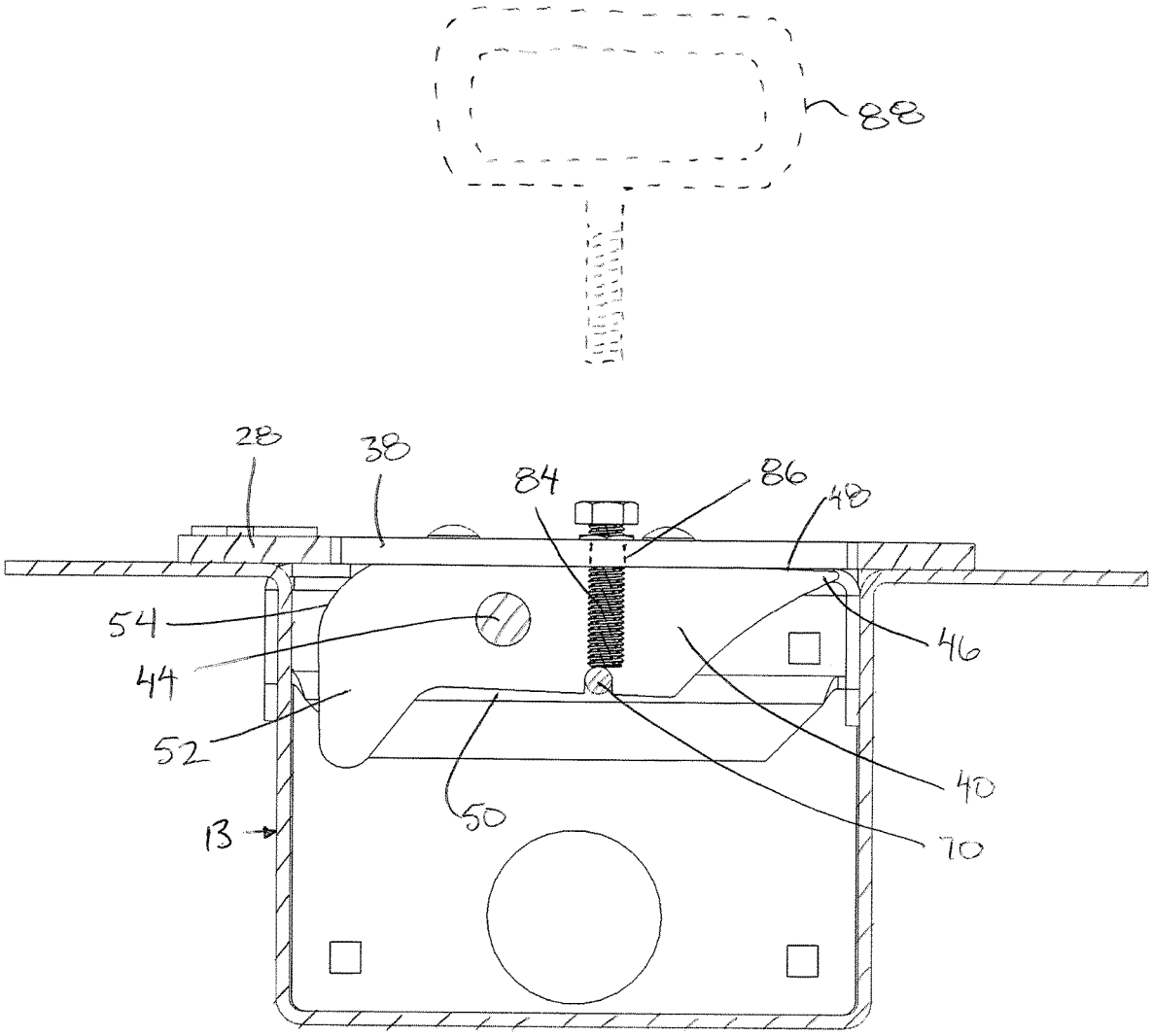
FIG. 6 is a sectional view along the line 6-6 in FIG. 2.
Figure 7:
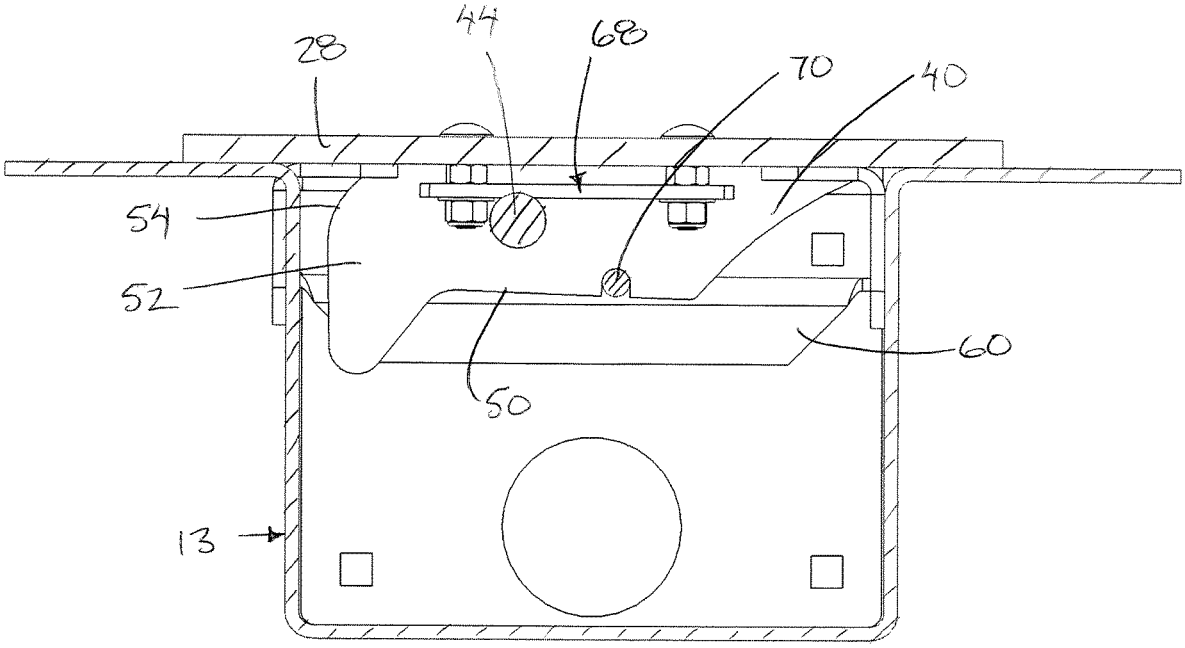
FIGS. 7 and 8 are sectional views along the line 7-7 in FIG. 2 illustrating the tire puncturing frame in the stored position and the working position relative to the upper stop member.
Figure 8:
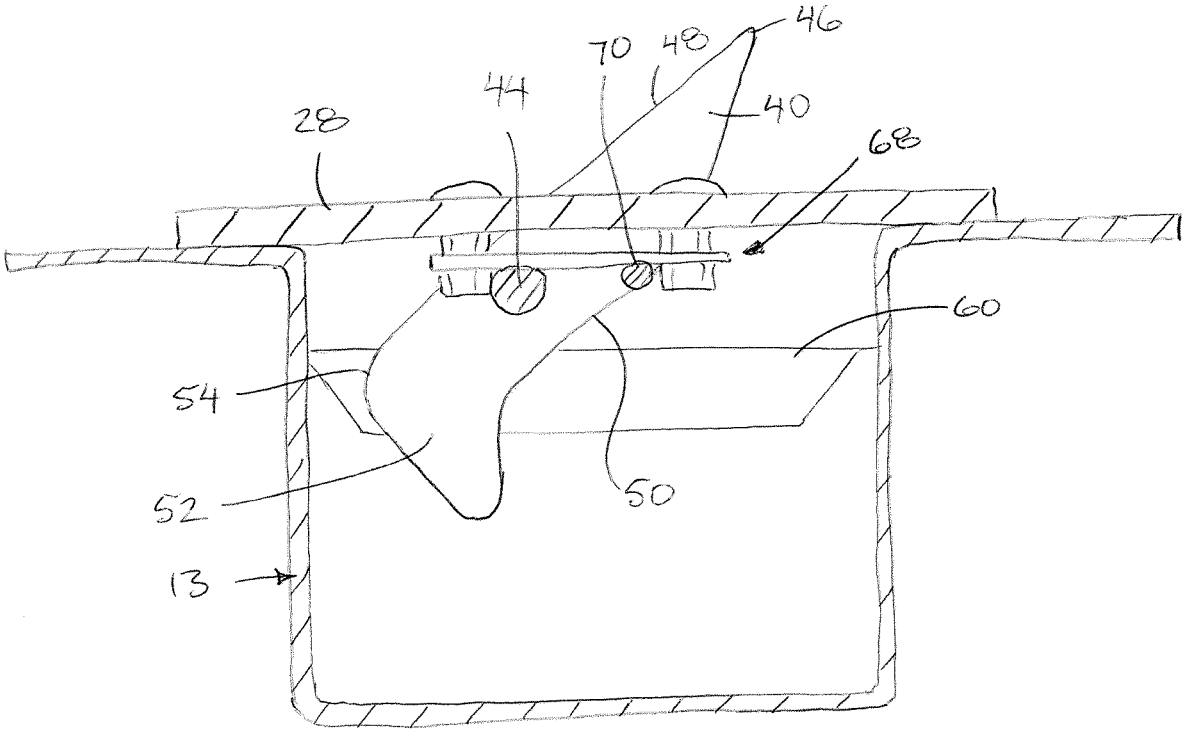
Figure 9:
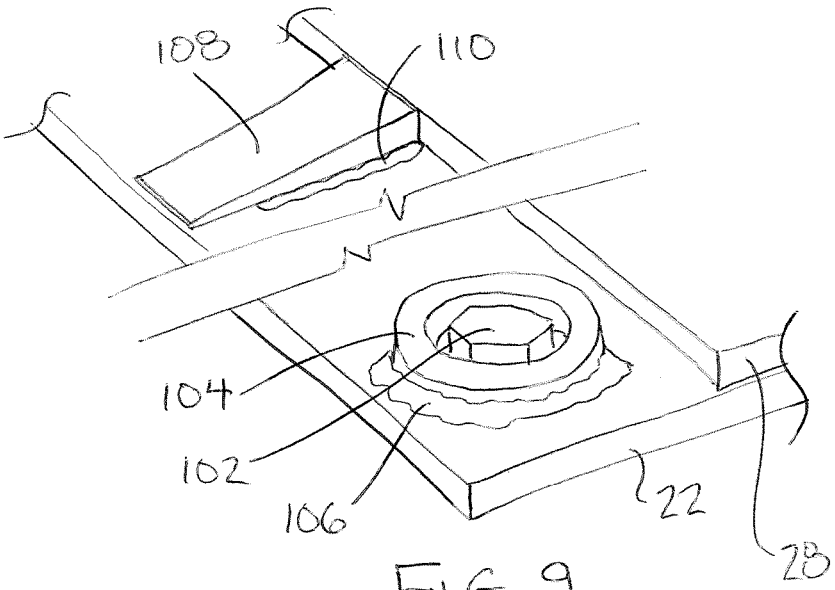
FIG. 9 is a perspective view of a bolt guard and a top plate guard supported on the lower housing of the device according to FIG. 1.

Referring to the accompany figures, there is illustrated a traffic control device generally indicated by reference numeral 10. In a deployed configuration, the traffic control device allows safe passage of vehicles across the device in a first direction, while being configured to puncture tires of the vehicle if the vehicle passes over the device in an opposing second direction.

The traffic control device 10 is particularly suited for use with a roadway 12 accommodating vehicular traffic longitudinally in a travel direction of the roadway in which the roadway may be formed of various common roadway materials such as concrete, asphalt, etc. In the illustrated embodiment, the device is at least partially recessed relative to the road surface of the roadway that supports the vehicular traffic thereon. The traffic control device is elongate in a longitudinal direction and is supported within the roadway such that the longitudinal direction of the device is oriented perpendicularly to the travel direction of the roadway.

The device 10 comprises a housing 13 which is mounted within a suitable trough formed in the roadway so as to be recessed relative to the upper road surface of the roadway. The housing is elongate in the longitudinal direction of the device between two opposed ends 14 of the housing while having a generally rectangular shape in cross section along the length of the housing between the opposing ends.

The housing 13 includes a bottom plate 16 which is rectangular in shape and horizontally oriented to span the full length of the housing between the opposing ends and to span the full width of the housing between laterally opposing side walls 18 of the housing in a lateral direction. The side walls 18 of the housing extend vertically upward from opposing side edges of the bottom plate 16 to similarly span the full length of the housing in the longitudinal direction between the opposing ends. A pair of end walls 20 enclose opposing ends of the housing between the side walls 18 to span the full height of the side walls.

The housing 13 further includes a pair of mounting flanges 22 that protrude laterally outwardly from the two side walls 18 respectively while spanning the full length of the housing in the longitudinal direction. The mounting flanges 22 lie in a common horizontal plane with one another and the top edges of the side walls 18 so as to be parallel to the bottom plate 16 of the housing. The housing is intended to be mounted within the trough formed in the roadway such that the mounting flanges 22 lie flat against the upper road surface of the roadway so that substantially the full height of the housing below the mounting flanges is recessed downwardly into the roadway relative to the road surface thereof.

A plurality of fastener apertures 24 are provided at longitudinally spaced positions along each mounting flange 22 to receive a suitable anchor penetrated therethrough such as a concrete fastener or concrete anchor 100 with a head 102 mounted against the top side of the mounting flange to hold the mounting flanges down against the upper road surface of the roadway and thereby maintain the housing mounted in fixed relation to the roadway.

To protect the protruding fastener heads 102 from being sheared off from street clearing equipment for example, a fastener guard 104 may be mounted on the top side of the mounting flange 22 in association with each fastener aperture 24. In the illustrated embodiment, the fastener guard comprises an annular ring of rigid metal which is fixed to the top side of the mounting flange 22, for example by welding, such that the guard 104 surrounds the respective aperture. A height of the guard 104 in the illustrated embodiment is slightly less than a height of the fastener head 102; however, the guard may be equal or greater in height than the head 102 in further embodiments. The guard 104 may be secured using a weld bead 106 about the outer circumference of the guard so as to form a ramped surface that assists in guiding passing equipment up and over the guard 104 which assists in guiding the passing equipment over the fastener head 102 as well, and thereby prevent shearing of the bolt head. An interior diameter of the guard 104 is sized so that the guard is spaced radially outward from the bolt about the full circumference thereof to define an annular space capable of receiving a socket wrench or other comparable tool about the fastener head without interference from the guard 104.

Additional fastener apertures 25 may be formed in the side walls and the end walls of the housing to receive additional fasteners or anchors which extend into the surrounding roadway to assist in mounting the housing in fixed relation to the roadway.

The side walls 18, the bottom plate 16, and the mounting flanges 22 may be formed of a common rigid plate of metal which has been suitably formed into the appropriate shape such that the side walls, the mounting flanges and the bottom plate form an integral and seamless unitary body of material upon which the end walls are mounted in fixed relation. The side walls, the end walls, the mounting flanges and the bottom plate collectively define a lower housing having an access opening at the top side thereof bounded by the top edges of the end walls 20 and the side walls 18 respectively. Various drain apertures 26 are located in the bottom wall and the end walls of the housing for draining any precipitation which may collect within the housing.

The housing 13 further includes a top plate 28 which is selectively mounted across the top of the housing for enclosing the access opening spanning the top side of the lower housing in a normal mounted position of the top plate relative to the lower housing. The top plate 28 is a rigid plate having sufficient strength to support vehicles rolling across the top plate as vehicles pass over the housing when travelling along the roadway in the travel direction. The top plate has suitable dimensions to span the full length of the housing in the longitudinal direction such that opposing ends of the top plate overlap over the top edge of both end plates. The top plate also fully spans the width of the access opening of the lower housing in the lateral direction by being sized to be slightly wider between opposing side edges of the top plate than the lateral width between the side walls 18 of the lower housing. In this manner, the opposing side edges 30 of the top plate overlap overtop the top side of the two mounting flanges 28 respectively at laterally opposing sides of the housing along the full length of the housing in the longitudinal direction.

To assist in locating the top plate in the longitudinal direction and in the lateral direction relative to the lower housing, each of the end walls includes a locator tab 32 projecting upwardly from the top edge of the end wall by a height corresponding approximately to the thickness of the top plate. Each end of the top plate 28 is provided with a corresponding recess extending longitudinally inward from the outer end thereof such that the recess is sized to receive the locator tab 32 therein in a mounted position with the top edge of the locator tabs being flush with the upper supporting surface of the top plate 28.

To further assist in locating the top plate relative to the lower housing and to fix the top plate from lifting off of the lower housing, the lower housing further includes a plurality of fastener flanges 34 which are fixed to respective ones of the side walls 18 or end walls 20 of the lower housing in which the flanges 34 extend horizontally inward from the respective wall of the housing so as to be parallel and coplanar with the mounting flanges 22 of the housing. In this manner, when the top plate 28 lies flat against of the upper surface of the mounting flanges 22, the top plate also lies flat against the upper surface of the fastener flanges 34. Cooperating apertures 36 are provided in each fastener flange 34 and at the corresponding location in the top plate 28 to enable threaded fasteners received through the cooperating apertures to fasten the top plate 28 releasably relative to the lower housing. The fastener flanges 34 are provided at laterally spaced apart positions on each end wall so as to be located in all four corners of the lower housing as well as being located at a plurality of longitudinally spaced apart positions along each side wall 18 to provide adequate structural support to retain the top plate in fixed relation to the lower housing.

As shown in the illustrated embodiment, when the top plate 28 overlaps over the top side of the mounting flanges 22, the opposing side edges of the top plate protrude upwardly from the mounting flanges in a manner that may cause street equipment such as the scraper blade of snow clearing equipment to be caught on the side edges while passing over the traffic control device. To protect the top plate from being engaged and sheared off of the housing by the street equipment passing over the traffic control device, additional guard members 108 are mounted on the top side of each of the mounting flanges 22. Each guard member 108 is mounted in fixed relation onto a respective one of the mounting flanges at an intermediate location between a respective adjacent pair of the fastener apertures 24. Each guard member 108 has an upper surface which is ramped in profile to extend laterally inwardly from an outer edge of the mounting flange 22 to the corresponding side edge of the top plate. At the inner end of the guard member 108, the height of the guard member is approximately equal to the thickness of the top plate. The lateral distance between the guard members 108 on one side of the traffic control device to the guard members 108 on the other side of the traffic control device is approximately equal to the lateral width of the top plate. In this manner, the guard members 108 serve to both (i) guide street equipment upwardly and over the top plate as the equipment passes over the traffic control device, and (ii) locate the top plate in the lateral direction relative to the lower housing. The guard members 108 may be fixed to the mounting flanges by weld beads 110 between the sides of the guard member 108 and the top side of the mounting flanges 22.

The top plate further includes a plurality of spaced apart upper openings 38 formed therein in which the upper openings are evenly spaced apart in the longitudinal direction of the housing. Each upper opening comprises an elongate slot which is parallel to the lateral direction and perpendicular to the longitudinal direction of the housing such that the upper openings are parallel to one another. Each upper opening 38 cooperates with a respective tire puncturing member 40 in operation as described in further detail below.

The housing 13 receives a tire puncturing frame 42 therein in which the tire puncturing frame is a frame assembly comprised of the tire puncturing members 40 which are coupled in fixed relation to one another together with additional components of the tire puncturing frame as described herein such that the entirety of the tire puncturing frame acts as a unitary structure. More particularly the tire puncturing frame is supported within the housing for pivotal movement between a storage position in which the tire puncturing members are fully received within the housing below the upper supporting surface of the top plate of the housing and a working position in which a portion of the tire puncturing members of the tire puncturing frame protrude upwardly from the upper surface of the top plate of the housing for puncturing tires of vehicles travelling over the housing in a prescribed direction.

The tire puncturing frame 42 further includes a pivot shaft 44 which is oriented in the longitudinal direction and which defines the pivot axis of the pivotal movement of the tire puncturing frame relative to the housing. The tire puncturing members are mounted onto the pivot shaft 44 at evenly spaced apart positions in the longitudinal direction corresponding to the spacing of the upper openings 38 in the top plate of the housing such that each tire puncturing member is aligned with a corresponding one of the upper openings in the housing. The tire puncturing members 40 are mounted in fixed relation to the pivot shaft for pivotal movement together about the pivot axis thereof.

Each tire puncturing member 40 is formed of a flat rigid plate of material oriented within a respective vertical plane that is aligned in the lateral direction of the housing so as to be perpendicular to the longitudinal direction of the housing. The plate forming the tire puncturing member is pivotal within its respective plane between the stored position and the working position thereof.

Each tire puncturing member 40 includes a puncturing portion extending radially from the pivot axis in a common first direction towards a respective pointed apex 46 or pointed end of the member. The apexes 46 are all aligned with one another along a common imaginary axis which is parallel to the pivot axis.

In the stored position, a top edge 48 of the plate forming each tire puncturing member 40 is oriented to be parallel to and adjacent to the top plate 28 of the housing. The apex 46 is located at one end of the top edge 48 at the intersection of the top edge and an opposing lower edge 50 which is sloped upwardly and laterally outwardly to the apex in the stored position. More particularly, the apex 46 is located to be directly adjacent or in very close proximity to one of the side walls of the housing in the stored position.

In the working position, the top edge 48 extends upwardly and laterally outwardly at a slope with the apex 46 being located at the top end so as to be spaced above the upper supporting surface of the top plate of the housing.

Each tire puncturing member further includes a counter balance portion 52 in which all of the counterbalance portions extend from the shaft in a common second direction which is diametrically opposite from the corresponding apexes 46 extending in the first direction. The counterbalance portions 52 provide some balancing of the tire puncturing members 40 about the pivot axis thereof relative to the housing.

In the stored position, the top edge 48 of each tire puncturing member 40 extends laterally outward beyond the pivot axis opposite the apex 46 to a convex edge 54 which is curved laterally outwardly and downwardly into the housing so as to encourage any debris on the counter balance portion 52 to fall into the housing.

In the working position, the counterbalance portion 52 is pivoted downwardly towards the bottom of the housing relative to the stored position while remaining laterally offset from the pivot axis relative to the corresponding apex throughout a full range of motion of the tire puncturing frame between the stored and working positions thereof.

The tire puncturing frame 42 further includes a plurality of counterweights 56 mounted in fixed relation thereon so as to be pivotal together with the frame about the pivot axis relative to the housing. Each counterweight 56 mounts to span a longitudinal gap between a respective pair of the tire puncturing members 40 in connection between the counterbalance portions 52 thereof such that each counterweight is offset laterally from the pivot axis of the frame opposite to the apex 46 throughout the full range of motion of the frame between the stored and working positions thereof.

The counterweights have a substantial mass such that the counterweights provide a biasing under action of gravity alone to bias the entire tire puncturing frame 42 from the stored position towards the working position throughout the full range of motion thereof. For example, a force in the range of 10 to 20 pounds must be applied downwardly to one of the apexes 46, or distributed across a plurality of the apexes, in order to overcome the biasing effect of the counterweights and pivot the tire puncturing frame from the working position to the stored position thereof. Each counterweight has an upper surface 58 which follows the contour of the corresponding pair of tire puncturing members so as to be substantially flush with the top edge and the convex edge 54 thereof across the width of the counterbalance portion.

The number of counterweights is selected to provide sufficient mass to provide adequate biasing of the tire puncturing frame towards the working position without causing interference of the counterweights with other components of the traffic control device. In the illustrated embodiment, a series of 12 tire puncturing members 40 are provided in the housing which define six adjacent pairs; however, only four counterweights are provided in this instance to provide space between other adjacent pairs of the members for accommodating other components of the device as described in the following.

In order to support the tire puncturing frame 42 for pivotal movement within the housing, the pivot shaft 44 thereof is pivotally supported at a plurality of longitudinally spaced apart locations. At each supporting location, a housing crossbar 60 is connected laterally between the opposed side walls 18 of the housing in fixed relation thereto at an intermediate location between the top and bottom side of the housing. A bushing block 62 is supported upon the crossbar in which the bushing block is formed of a plastic material having a low coefficient of friction. A semicircular recess is provided in an upper surface of the bushing block in which the recess spans the full width of the block in the longitudinal direction to receive a portion of the pivot shaft 44 cradled therein so that the pivot shaft is rotatable relative to the bushing block.

A cover plate 64 is provided for mounting above the bushing block using threaded fasteners at laterally opposed ends of the cover plate to secure the pivot shaft rotatably against the bushing block. The cover plate includes a semicircular formation thereon connected between a pair of opposing fastener flanges such that the semicircular formation extends partway about the circumference of the pivot shaft opposite the corresponding recess in the bushing block 62. The cover plate may include a lining of plastic material having a low coefficient of friction similar to the bushing block.

Threaded fasteners are penetrated through the fastener apertures in the flanges at opposing ends of the cover plate 64 so that the fasteners also extend through corresponding apertures in the bushing block 62 and in the housing crossbar 60 therebelow to retain the tire puncturing frame for pivotal movement about a common pivot axis of the bearing box in the mounted position within the housing. The housing crossbars 60 are each located between an adjacent pair of tire puncturing members 40 at a location where there is no counterweight 56 such that there is no interference therebetween.

The traffic control device 10 further includes a lower stop member 66 defining a lower limit to be engaged by the pivoting tire puncturing frame 42 in the stored position, and a pair of upper stop members 68 defining an upper limit to be engaged by the pivoting tire puncturing frame 42 in the working position. More particularly, the tire puncturing frame includes a plurality of frame crossbars 70 fixed thereon for pivoting together with the tire puncturing members between the stored and working positions thereof such that the frame crossbars 70 engage the upper and lower stop members in the working position and the stored position respectively.

Each frame crossbar 70 is connected between an adjacent pair of the tire puncturing members 40 at a location which is not occupied by one of the housing crossbars 60 so as to avoid any interference therebetween. The crossbars 70 on the frame 42 are all aligned along a common axis which is parallel to the pivot axis of the frame at a location offset towards the apexes in a common lateral direction from the pivot axis throughout a full range of motion of the frame between the stored and working positions thereof. Throughout the full range of motion of the tire puncturing frame, the frame crossbars 70 engage the lower stop member 66 at a location below the elevation of the pivot axis in the stored position and engage the upper stop members at a location above the elevation of the pivot axis in the working position.

The lower stop member 66 comprises a pad 72 of resilient material supported on an auxiliary crossbar 74 that is fixed relative to the lower housing. The auxiliary crossbar 74 extends in the lateral direction between opposing side walls 18 of the lower housing between an adjacent pair of the tire puncturing members 40 at a location which is not occupied by any of the housing crossbars 60 or the counterweights 56. The resilient pad 72 is mounted on the top side of the rigid auxiliary crossbar using threaded fasteners penetrated through the pad and the crossbar at laterally opposing ends of the pad so as to receive a corresponding one of the frame crossbars 70 engaged at an intermediate location thereon in the stored position to prevent further pivotal movement of the tire puncturing frame beyond the stored position. Varying the thickness of the pad 72 mounted on the crossbar enables the height of the apexes of the tire puncturing members to be calibrated in elevation relative to the housing in the stored position.

An optional fastener aperture 76 is provided on the auxiliary crossbar in proximity to the location of engagement of the corresponding frame crossbar 70 of the tire puncturing frame to enable a suitable fastener received within the aperture 76 to engage the frame crossbar 70 of the tire puncturing frame and clamp the frame crossbar against the resilient pad 72 in a manner which selectively retains the tire puncturing frame in the stored position until the fastener is removed from the aperture 76.

Two upper stop members 68 are provided within the housing at longitudinally spaced apart locations immediately below the top plate 28 of the housing. More particularly each upper stop member 68 is secured to the underside of the top plate using threaded fasteners penetrated through laterally opposing ends of a pad 78 of resilient material forming the upper stop member such that the fasteners can also be penetrated through corresponding fastener apertures in the top plate. Each upper stop member is coupled to the top plate at a location which is centred longitudinally between a pair of the upper openings 38 in the top plate. The pad 78 forming each upper stop member is positioned such that a central location on the upper stop member between the fasteners at opposing ends thereof is aligned with a corresponding one of the frame crossbars 70 on the tire puncturing frame when the tire puncturing frame is pivoted into the working position. By varying the thickness of the pad 78 or the number of stacked pads fastened to the underside of the top plate, the height of the bottom of the lowermost pad relative to the upper surface of the housing can be adjusted which in turn adjusts the elevation of the upper limit engaged by the tire puncturing frame in the working position so as to vary the height of the apexes of the tire puncturing frame relative to the upper surface of the housing in the working position.

In the illustrated embodiment, the pair of fasteners securing each pad 78 to the top plate of the housing includes a head engaged upon the upper surface of the housing and a threaded shaft penetrated downwardly through a corresponding aperture in the top plate of the housing to receive a spacer about the shaft engaged upon the bottom of the top plate of the housing such that the pad 78 is supported in a spaced apart relationship below the bottom surface of the top plate 28 of the housing. A central portion of the pad 78 between the fasteners at opposing ends thereof is thus effectively suspended in spaced apart relationship below the top plate of the housing thereabove at the location of engagement of the corresponding frame crossbar 70 of the tire puncturing frame thereon in the working position. Due to the resilient nature of the pad 78, the material of the pad can both be compressed and resiliently deflected upwardly towards the top plate thereabove to a small degree to provide some cushioning effect that absorbs the impact of the tire puncturing frame pivoting into the working position under the biasing force of the counterweights in the absence of any actuating force being applied to the portions of the tire puncturing members protruding above the upper surface of the housing.

The pivot shaft 44 is arranged to be longitudinally slidable within the respective bushing blocks 62 to allow some limited re-adjustment of the tire puncturing frame relative to the housing in the longitudinal direction. This serves to calibrate the positioning of the tire puncturing frame relative to the housing to ensure that the tire puncturing members are aligned with corresponding ones of the upper apertures 38 in the top plate 28 of the housing. Once the tire puncturing frame has been aligned longitudinally with the housing, the selected positioning of the frame relative to the housing can be set using one or more positioning collars 80 which are supported about the pivot shaft 44. Each collar is a lock member that is longitudinally slidable along the pivot shaft to a desired mounting location at which point a set screw threaded radially into the collar 80 can be tightened so that the engagement of the inner end of the set screw against the shaft fixes the location of the collar relative to the shaft. The collars 80 can be abutted axially against longitudinally opposing ends of one or more bearing blocks in a manner that restricts longitudinal sliding of the tire puncturing frame relative to the housing while not interfering with pivoting movement thereof relative to the housing between the stored and working positions thereof. Although the pivot shaft is axially slidable relative to the housing through a range of axial positions, the lock member defined by the collar 80 is supported on the pivot shaft so as to fix the pivot shaft relative to the housing at a selected one of the axial positions while enabling pivotal movement of the pivot shaft relative to the housing.

In some instances, it is desirable to supplement the biasing force provided by the counter weights 56 by using additional springs. An anchor flange 82 is provided at an intermediate location to extend horizontally inward from each of the end plates 20 of the housing. A torsion spring 83 can be mounted about the end of the pivot shaft 44 at each of the opposing ends of the housing such that opposing ends of each torsion spring can be fixed to the anchor flange 82 and a corresponding anchoring location on the adjacent one of the tire puncturing members 40 respectively so that the springs each provide additional biasing force to assist in biasing of the tire puncturing frame from the stored position towards the working position. When no springs are used, the actuation force that is required to be applied downwardly onto the apex of one of the tire puncturing members in the working position may be in the range of 10 to 20 pounds to pivot the tire puncturing frame into the stored position; however, when using additional springs at both ends, the actuating force to pivot the tire puncturing frame into the stored position from the working position may be increased to 40 to 60 pounds for example. Using only one spring will result in an intermediate actuating force being required for example. The use of one or two springs may be a temporary measure used only until the bearings have exceeded a break-in period for example.

In order to retain the tire puncturing frame in the stored position for a long duration, a latch bolt 84 may be used as a latch member to fix the tire puncturing frame in the stored position. In this instance a threaded aperture 86 is provided in the top plate which is aligned with a corresponding one of the frame crossbars 70 in the stored position so that the aperture 86 receives the latch bolt 84 threaded therein with the inner end of the latch bolt engaging the frame crossbar 70 to prevent upward pivoting of the crossbar and the connected tire puncturing frame from the stored position towards the working position thereof. The latch bolt 84 is sized such that when the head of the bolt is engaged against the upper surface of the top plate, the threaded shaft of the latch bolt spans the appropriate height from the upper surface of the top plate to the top side of a corresponding one of the frame crossbars 70 in the stored position to prevent upward movement of the crossbar from the stored position.

Optionally, a suitable carrying handle 88 may be provided having a handle portion size for gripping in the hand of a user and a threaded shaft connected in fixed relation thereto having similar threads as the latch bolt such that the handle 88 and the latch bolt 84 can be interchangeably mounted within the corresponding threaded aperture 86 in the top plate. In this manner, the threaded shaft of the handle can be used as a latch bolt to retain the tire puncturing frame in the stored position while simultaneously providing a temporary handle which is useful for handling and positioning of the device during installation in a roadway for example.

In further embodiments, for retaining the tire puncturing frame in the stored position, a latch pin receiving aperture may be located in a vertical orientation through any component of the tire puncturing frame, including an auxiliary tab formed on the shaft or on one of the tire puncturing members. The latch pin receiving aperture is provided on the frame at a location such that the aperture is aligned with a corresponding aperture in the top plate in the stored position. In this instance a latch pin having an elongate shaft may be slidably inserted through the aperture in the top plate and the corresponding aperture in the tire puncturing frame in a manner that prevents the tire puncturing frame from pivoting away from the stored position.

Although the illustrated embodiment of the traffic control device shown in the accompanying figures is intended for in-ground installation recessed relative to the upper surface of a roadway, numerous operating components of the traffic control device as described above may be readily adapted for use in a traffic control device having a housing which is instead adapted for flush mounting fully above the upper surface of the roadway.

According to the illustrated embodiment, the traffic control device is installed in a roadway such that the longitudinal direction of the housing is oriented perpendicularly to a travel direction of vehicular traffic on the roadway. Installation may involve forming a trench in the roadway into which the housing is recessed. If it is desirable to maintain the device in the stored position, one of various latching means described above may be used long-term. When it is desired to operate the traffic control device for puncturing tires of the vehicles travelling over the device in one prescribed direction only, the latching devices are removed such that the counterweights automatically bias the tire puncturing frame into the working position. Due to the upwardly sloped orientation of the top edge of the tire puncturing members towards an apex at one end that is laterally offset from the pivot axis of the frame, vehicles rolling over the device opposite to the offset direction of the apexes of the tire puncturing members will cause the apexes to penetrate and puncture tires of the vehicle. Alternatively, vehicles passing in the opposing direction corresponding to the lateral direction that the tire puncturing members extend from the pivot axis to the apexes thereof, the rolling action of the tires across the upper surface of the top plate of the housing cause the tire puncturing members to be deflected downwardly into the stored position to allow a vehicle to fully pass over the housing without damaging the tires.

Due to the top plate being secured with removable threaded fasteners, ready access can be provided to the lower housing and the operating components therein. Once the top plate is removed, removal of simple threaded fasteners associated with each bushing block enables the cover plates of the bushings to be readily removed so that the entire tire puncturing frame can be removed and interchange if desired without the bushing blocks 62 being required to be removed from the housing and without requiring the tire puncturing members to be removed from the pivot shaft. Interchanging the tire puncturing frame may be desired where it is desired to vary the profile of the tire puncturing members to vary the aggressiveness of the apexes in terms of their ability to puncture tires.

Removal of the top plate also provides ready access for attaching or removing springs to complement the biasing provided by the counterweights. Access is also provided for varying the height of the upper and lower stop members to calibrate the positioning of the tire puncturing members in either of the stored or working positions thereof.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A traffic control device for use with a roadway receiving vehicles travelling longitudinally along the roadway in a travel direction, the device comprising:

a housing which is elongate in a longitudinal direction and which is adapted to be mounted to extend across the roadway transversely to the travel direction;

the housing having an upper supporting surface adapted to support the vehicles rolling over the housing;

the upper supporting surface having a plurality of upper openings formed therein;

a plurality of tire puncturing members having respective pointed ends adapted to puncture tires of the vehicles;

the tire puncturing members being pivotal relative to the housing about a common pivot axis between a stored position in which the tire puncturing members are retracted below the upper supporting surface of the housing and a working position in which the pointed ends of the tire puncturing members protrude upwardly beyond the upper supporting surface of the housing through the upper openings formed therein;

wherein the tire puncturing members are joined in fixed relation to one another to define a tire puncturing frame which is collectively pivoted between the working position and the stored position;

a biasing arrangement biasing the tire puncturing frame towards the working position;

the housing further comprising a threaded aperture formed therein;

a latch bolt threadably received within the threaded aperture in the housing such that the latch bolt is movable between a first position in which the latch bolt engages the tire puncturing frame in the stored position to retain the tire puncturing frame in the stored position and a second position in which movement of the tire puncturing frame into the working position is unobstructed by the latch bolt.

2. The device according to claim 1 wherein the latch bolt is separable from the housing in the second position.

3. The device according to claim 1 further comprising a latching crossbar mounted on the tire puncturing frame in connection between an adjacent pair of the tire puncturing members at a location spaced radially from the common pivot axis, the latch bolt engaging the latching crossbar in the stored position.

4. The device according to claim 3 further comprising:

the tire puncturing frame comprising a shaft defining the common pivot axis of the tire puncturing frame;

the tire puncturing members being fixed onto the shaft to rotate with the shaft relative to the housing between the stored and working positions; and the latching crossbar lying parallel to the common pivot axis of the tire puncturing frame at a location spaced from the shaft.

5. The device according to claim 4 wherein the tire puncturing frame further comprises a plurality of auxiliary crossbars, each auxiliary crossbar being mounted on the tire puncturing frame in connection between a respective adjacent pair of the tire puncturing members at a location spaced radially from the common pivot axis.

6. The device according to claim 5 wherein the auxiliary crossbars and the latching crossbar are aligned with one another along a common axis which is parallel to the common pivot axis of the tire puncturing frame.

7. The device according to claim 1 wherein the housing further comprises a top plate extending across a top of the housing so as to define the upper supporting surface of the housing, the threaded aperture being located in the top plate.

8. The device according to claim 7 wherein the top plate is secured to the housing using threaded fasteners such that the top plate is readily separable from the housing.

9. The device according to claim 7 further comprising:

a first mating element on the top plate; and a second mating element on the housing, the second mating element forming a mating connection with the first mating element when the top plate is aligned with the housing.

10. The device according to claim 9 wherein one of the first mating element and the second mating element is a tab and another one of the first mating element and the second mating element is a recess receiving the tab therein in a mounted position of the top plate on the housing.

11. The device according to claim 7 wherein the housing further comprises:

a pair of mounting flanges protruding laterally outwardly from opposing side walls of the housing so as to be adapted to overlap the roadway;

the top plate being supported in overlapping relationship overtop of a top side of a corresponding one of the mounting flanges at each side edge of the top plate.

* * * * *